US005207626A

United States Patent [19]

Einhorn et al.

[11] Patent Number: 5,207,626

[45] Date of Patent: May 4, 1993

[54] RESISTANCE EXERCISE APPARATUS FOR THE MUSCLES ASSOCIATED WITH THE SCAPULA

[76] Inventors: Andrew R. Einhorn, 7311 Coho Dr. #103, Huntington Beach, Calif. 92648; Michael Sawyer, 1005 Mar Vista Ave., Seal Beach, Calif. 90740

[21] Appl. No.: 889,478

[22] Filed: May 24, 1992

[51] Int. Cl.[5] ..... A63B 21/04

[52] U.S. Cl. ..... 482/123; 482/124; 482/130; 482/139; 2/310

[58] Field of Search ..... 482/121, 122, 123, 124, 482/129, 130, 139, 66, 69; 182/3, 7, 9; 2/310-311, 312, 327, 328, 335, 303; 602/19, 32, 20, 33, 36; 128/874, 875

[56] References Cited

U.S. PATENT DOCUMENTS

| | | | |
|---|---|---|---|
| 1,402,179 | 1/1922 | Piscitelli . | |
| 2,667,917 | 2/1954 | Dustin | 182/7 |
| 3,499,441 | 3/1970 | Hall | 602/19 |
| 4,073,490 | 2/1978 | Feather | 482/129 |
| 4,188,944 | 2/1980 | Augustyniak | 602/20 |
| 4,644,939 | 2/1987 | Coleman | 602/19 |
| 4,645,204 | 2/1987 | Berger . | |
| 4,905,713 | 3/1990 | Morante | 602/20 |
| 4,947,870 | 8/1990 | Larcher | 2/310 |
| 4,961,573 | 10/1990 | Wehrell . | |
| 5,141,482 | 8/1992 | Hern | 482/139 |

*Primary Examiner*—Richard J. Apley
*Assistant Examiner*—Lynne A. Reichard

[57] ABSTRACT

An apparatus is provided for therapeutic exercising of the scapula related muscles of a body. A scapula harness fits tightly over a shoulder and an upper arm of the body and extends over a breast and an opposing scapula area of the body. The harness has a plurality of attachment straps, each of which has a downwardly extending attachment end. A plurality of urging springs are each connected to one of the attachment ends and establish a variable tension force to each attachment strap. A plurality of tensioning straps are each connected at one end to one of the urging springs so that a force applied to any one of the tensioning straps causes one of the urging springs to extend. A seat has a horizontal, upward facing surface for supporting the body in a seated position, a peripheral edge, and at least one holding clamp for holding the straps in fixed positions and under a desired tension. The tension force is transferred by the attachment strap through the harness to the scapular muscles, thereby providing resistance to upward, forward, and rearward motion of the scapula muscles during exercising. A colinear tensioning strap and an urging spring attached to the tensioning strap may be further included for causing a resistance vector in a horizontal plane so that the scapular related muscles may be exercised by moving the body so that the harness moves downwardly and posteriorly.

9 Claims, 2 Drawing Sheets

RESISTANCE EXERCISE APPARATUS FOR THE MUSCLES ASSOCIATED WITH THE SCAPULA

FIELD OF THE INVENTION

This invention relates generally to therapeutic exercising devices, and, more particularly, to a device for therapeutic exercising of the muscles associated with the scapula region.

BACKGROUND OF THE INVENTION

Exercising devices for the shoulder, or scapula, region of the body are known in the prior art. For example, U.S. Pat. No. 1,402,179 to Piscitelli on Jan. 3, 1922, illustrates on exercising device in combination with a harness. Such a device is intended for strengthening primarily the muscles associated with the arms, and is particularly well-suited for strengthening muscles used in the sport of boxing. Moreover, such a device is extremely portable, thereby extending the usefulness of such a device outside of a gym or physical therapy center. However, such a device is not well-suited for full therapeutic exercising of the muscles associated with the scapula region since such a device tends to exert force in only one direction, toward the body. As the shoulder girdle comprises four individual joints that work together to permit the greatest range of movement possible in the human body, a variety of resistive forces must be available to adequately exercise all of the muscles associated with the scapula region. Moreover, some muscle groups in this region are naturally stronger than other muscle groups, and various therapeutic treatments require that a varying degree of exercise and resistive force be applied to these different muscle groups individually. Such a device, therefore, while being portable and easy to use, does not fully exercise the muscles of the scapula region.

Other prior art devices are known that can be configured to exercise certain scapula muscle groups. However, such devices are typically heavy, non-portable gym equipment, or the like, and are not easily portable. Further, such devices are costly to manufacture.

Clearly there is a need for a portable exercising device that fully exercises the muscles of the scapula region. Such a needed device would be relatively simple to manufacture, configure, and use. Moreover, such a needed device would allow varying degrees of resistive force to be applied to different scapula regions during use. The present invention fulfills these needs and provides further related advantages.

SUMMARY OF THE INVENTION

The present invention is an apparatus for therapeutic exercising of the scapula related muscles of a body. A scapula harness fits tightly over a shoulder and an upper arm of the body and extends over a breast and an opposing scapula area of the body. The harness has a plurality of attachment straps, each of which has a downwardly extending attachment end. A plurality of urging means are each connected to one of the attachment ends and establish a variable tension force to each attachment strap. The tension force is transferred by the attachment strap through the harness to the scapular muscles, thereby providing resistance to upward, forward, and rearward motion of the scapula muscles during exercising. The attachment straps include two anteriorly positioned straps and two posteriorly positioned straps. A plurality of tensioning straps are each connected at one end to one of the urging means so that a force applied to any one of the tensioning straps causes one of the urging means to extend. In this manner a biasing force is applied to each attachment end.

A seating means has a horizontal, upward facing surface for supporting the body in a seated position, a peripheral edge, and a holding means for holding the straps in fixed positions and under a desired tension. Each holding means includes an associated entry means positioned such that each one of the tensioning straps, when inserted into the associated entry means, is positioned approximately colinearly with respect to the associated attachment strap. Alternatively, each holding means is a plurality of clamping means, each of which are pivotally fixed to the seating means to enable each of the tensioning straps to be clamped at a desired position so that each attachment strap is able to transfer a selected tensioning force, at a selected angle, to the harness.

In operation, a person wears the harness over one shoulder, sits on the seating means, and connects each urging means to the associated attachment end. The person then adjusts each holding means such that the tensioning straps impart a desired force to the harness. The person then exercising the scapula related muscles by moving the harness upwardly and posteriorly, upwardly and anteriorly, and upwardly and neutrally. A colinear tensioning strap and an urging means attached to the tensioning strap may be further included for causing a resistance vector in a horizontal plane, parallel to the plane of the scapula, so that the scapular related muscles may be exercised by moving the body so that the harness moves downwardly and posteriorly. The present invention provides a portable exercising device that fully exercises the muscles of the scapula region. The present invention is simple to manufacture, to configure, and to use. Moreover, the present invention allows a varying degrees of resistive force to be applied to different scapula regions during use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
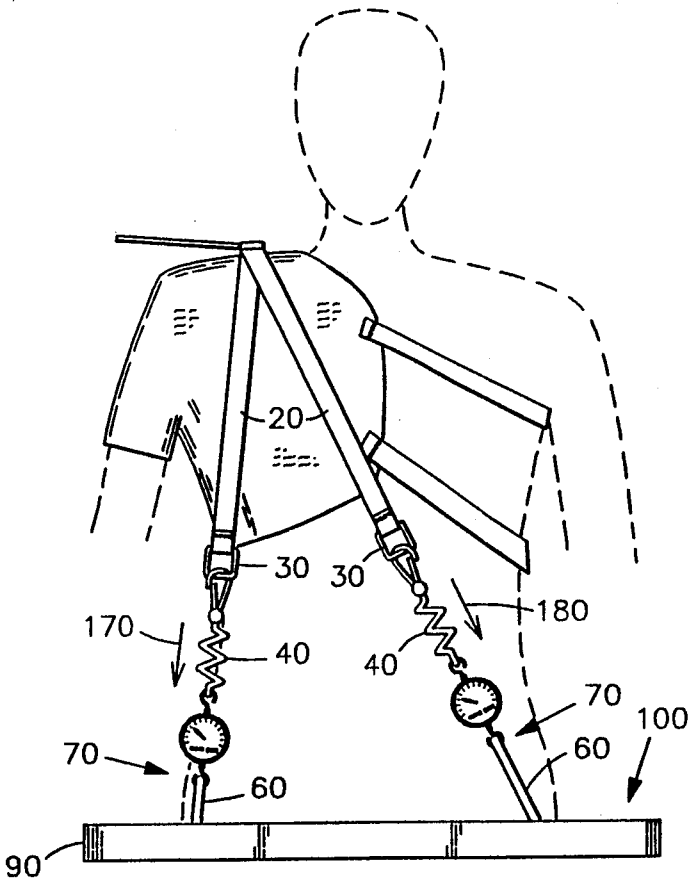
FIG. 2 is a rear elevational view of the invention, illustrating a posterior side of the harness of FIG. 1.
Figure 1:
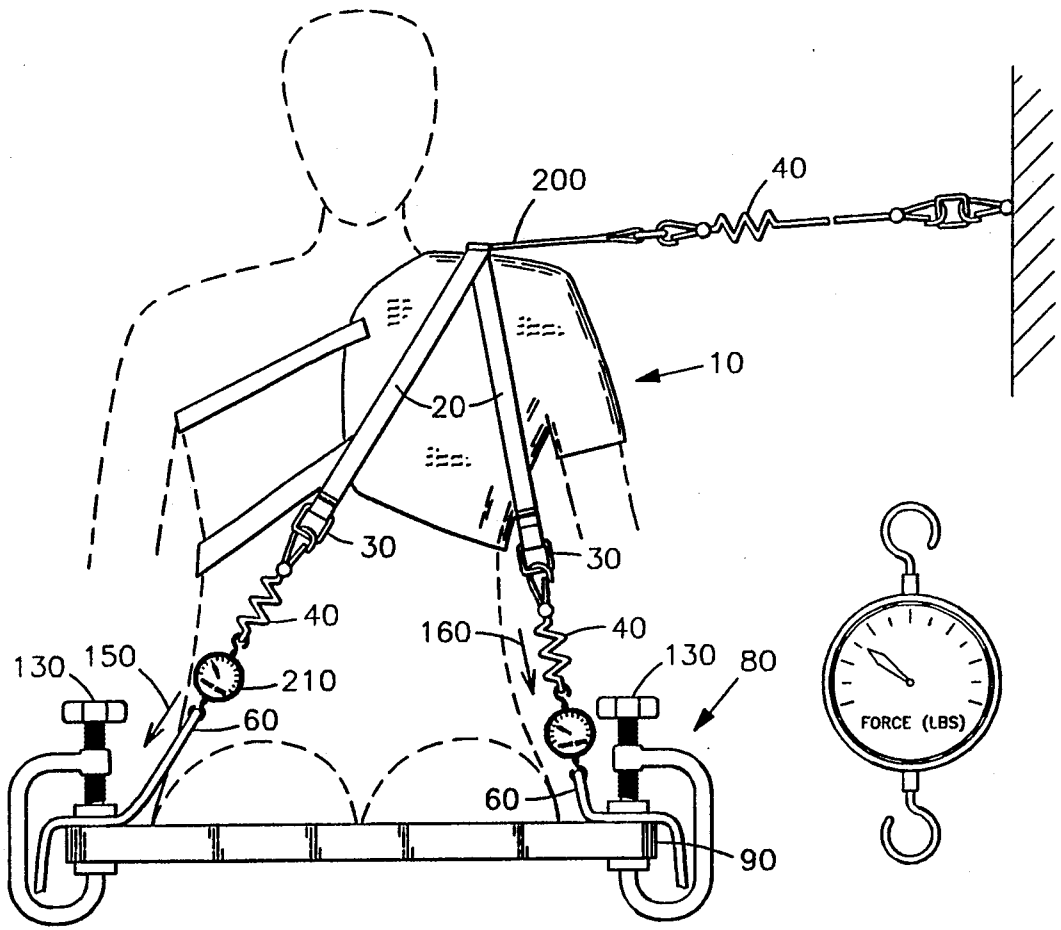
FIG. 1 is a front elevational view of the invention, illustrating a harness of the invention as worn by a person partially represented in phantom outline.
Figure 5:
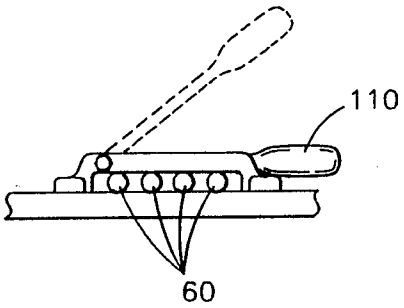
FIG. 5 is a partial front elevational view of the invention, illustrating a holding means of the tensioning straps of FIG. 4.
Figure 4:
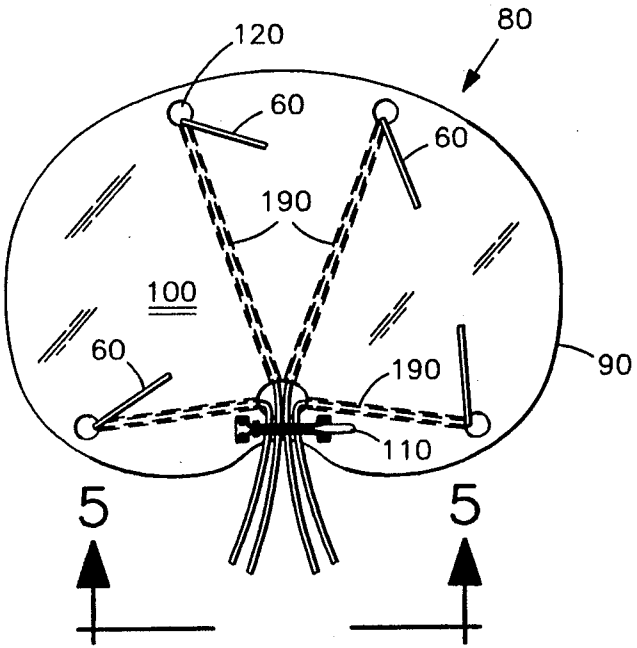
FIG. 4 is a partial top plan view of the invention, illustrating passageways for receiving tensioning straps of the invention.
Figure 3:
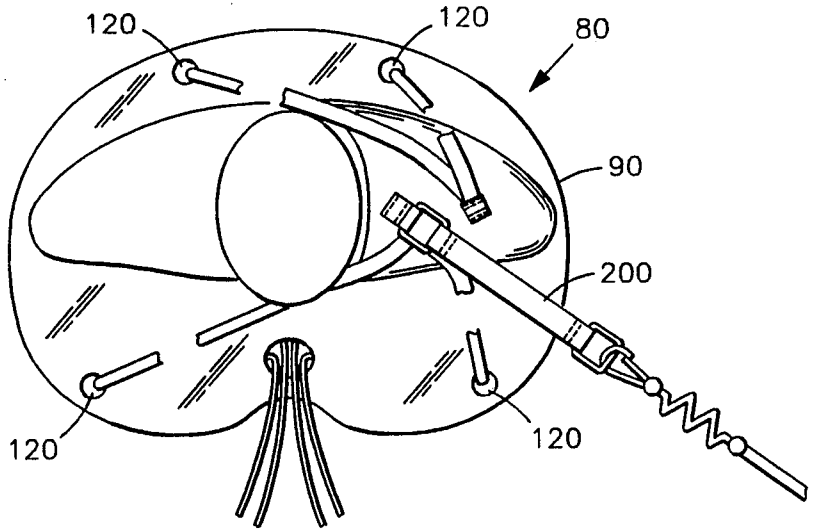
FIG. 3 is a top plan view of the invention.

FIGS. 1 and 2 show an apparatus for therapeutic exercising of the scapula related muscles of a body. A scapula harness 10 fits tightly over a shoulder and an upper arm of the body and extends over a breast and an opposing scapula area of the body. The harness 10 has a plurality of attachment straps 20, each of which has a downwardly extending attachment end 30. Preferably, the harness 10 is formed symmetrically so that the harness 10 may be worn on either side of the body with equal facility. The harness 10 is preferably manufactured from a strong, semi-flexible material, such as leather or a rubber foam material.

A plurality of urging means 40 are each connected to one of the attachment ends 30 and are extensible from the attachment end 30 to establish a variable tension bias condition for applying a tensile force to each one of the attachment straps 20. The tensile force is transferred by the attachment strap 20 to the harness 10, and from the harness 10 to the scapular muscles, thereby providing resistance to upward, forward, and rearward motion of the scapula muscles during therapeutic exercising. Preferably, the attachment straps 20 are tensioned by two anteriorly positioned tensioning straps 60 and two posteriorly positioned tensioning straps 60 (FIGS. 1 and 2). The urging means 40 are preferably strips of resilient rubber or other elastic material. Alternatively, urging means 40 may be coil springs or the like.

The tensioning straps 60 each have one end 70 connected to one of the urging means 40 so that a force applied to any one of the tensioning straps 60 causes one of the urging means 40 to extend. In this manner a biasing force is applied to one of the attachment ends 30. Preferably, each attachment strap 20 is positioned to transfer forces from the urging means 40 to the body. Preferably, such forces include a first anterior force 150, lying across the body at about 30 degrees off the vertical, and applied at the sternal costal junction of the fifth rib; a second anterior force 160 lying across the body at about 15 degrees off the vertical, and applied medially to the attachment of the serratus anterior on the fifth rib; a first posterior force 170 lying approximately plumb, and applied to the axillary border of the scapula at the level of the inferior angle; and a second anterior force 180 lying at about 45 degrees across the body and applied at the inferior angle of the scapula (FIGS. 1 and 2). A tensiometer 210 may be inserted between each of the tensioning straps 60 and the urging means 40 so that a selected tension may be applied at each attachment strap 20 (FIG. 1). Attachment straps 20 and tensioning straps 60 are preferably strong cords, straps, or the like.

A seating means 80, preferably manufactured from a strong plastic or wood material, has a horizontal, upward facing surface 100 for supporting the body in a seated position, a peripheral edge 90, and a holding means 130 for engaging each of the tensioning straps 60 to hold the straps 60 in fixed positions and under a desired tension (FIG. 1). In the preferred embodiment of the invention, the seating means 80 further includes a plurality of passageways 190 for receiving the tensioning straps 60 and for conducting the tensioning straps 60 from each of the strap entry means 120 to a common position at the peripheral edge 90 of the seating means 80. Preferably, each of the entry means 120 is positioned such that each one of the tensioning straps 60, when inserted into the associated entry means 120, is positioned approximately colinearly with respect to the associated attachment strap 20. In an alternative embodiment, each holding means 110 is a plurality of clamping means 130, each of which are pivotally fixed to the seating means 80 to enable each of the tensioning straps 60 to be clamped at a desired position so that each attachment strap 20 is able to transfer a selected tensioning force, at a selected angle, to the harness 10.

In operation, a person wears the harness 10 over one shoulder, sits on the seating means 80, and connects each urging means 40 to the associated attachment end 30. The person then adjusts each holding means 110 such that the tensioning straps impart a desired force to the harness. The person then exercising the scapula related muscles by moving the harness upwardly and posteriorly, upwardly and anteriorly, and upwardly and neutrally. A colinear tensioning strap 200 and an urging means 40 attached to the tensioning strap 200 may be further included for attachment to the harness 10 medial to the acromioclavicular joint. Such a strap 200 causes a resistance vector in a horizontal plane, parallel to the plane of the scapula, so that the scapular related muscles may be exercised by moving the body so that the harness 10 moves downwardly and posteriorly.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. An apparatus for therapeutic exercising of the scapula related muscles of a body comprising:

a scapula harness, the harness fitting tightly over a shoulder and an upper arm of the body and extending over a breast and an opposing scapula area of the body, the harness having affixed thereon a plurality of attachment straps, each of the straps having a downwardly extending attachment end;

a plurality of urging means, each one of the urging means being connected to one of the attachment ends and being extensible therefrom to establish a variable tension bias condition for applying a tensile force to one of the attachment straps, the force being transferred by the attachment strap to the harness and therefrom to the scapular muscles to provide resistance to upward, forward and rearward motion of the scapula muscles during exercising;

a plurality of tensioning straps, each of the tensioning straps having one end connected to one of the urging means so that a force applied to any one of the tensioning straps causes one of the urging means to extend thereby applying a biasing force to one of the attachment ends;

a seating means having a horizontal, upward facing surface for supporting the body in a seated position, a peripheral edge, and a holding means for engaging the tensioning straps to hold the straps in fixed positions and under a desired tension to exercise the scapula related muscles by moving the harness upwardly and posteriorly, upwardly and anteriorly, and upwardly and neutrally.

2. The apparatus of claim 1 wherein the holding means includes a plurality of tensioning strap entry means, into each of which one of said tensioning straps are inserted, each of the entry means being positioned such that each one of the attachment straps is positioned approximately colinearly with respect to the associated tensioning strap.

3. The apparatus of claim 1 wherein the tensioning straps holding means is a plurality of clamping means, each said clamping means being pivotally fixed to the seating means to enable each of the tensioning straps to be clamped at a position of choice so that each attachment strap is able to transfer a selected tensioning force, at a selected angle to the harness.

4. The apparatus of claim 1 wherein the attachment straps include two anteriorly positioned said straps and two posteriorly positioned said straps.

5. The apparatus of claim 4 wherein the attachment straps are positioned to transfer forces from the urging means, the forces being applied to the harness in a downward direction, a first anterior force lying across the body at about 30 degrees off the vertical, applied at the sternal costal junction of the fifth rib, a second anterior force lying across the body at about 15 degrees off the vertical, applied medially to the attachment of the serratus anterior on the fifth rib, a first posterior force lying approximately plumb, applied at the axillary border of the scapula at the level of the inferior angle, and a second anterior force lying at about 45 degrees across the body, applied at the inferior angle of the scapula.

6. The apparatus of claim 1 wherein the seating means further includes a plurality of passageways for receiving the tensioning straps for conducting the tensioning straps from each of the strap entry means to a common position at the peripheral edge of the seating means.

7. The apparatus of claim 1 further including a means for attachment medial to the acromioclavicular joint and further including a colinear tensioning strap and a said urging means attached thereto for developing a resistance vector in a horizontal plane, the vector being parallel to the plane of the scapula so that the scapular related muscles may be exercised by moving the body so that the harness moves downwardly and posteriorly.

8. The apparatus of claim 1 wherein the harness is formed symmetrically so that the harness may be worn on either side of the body with equal facility.

9. The apparatus of claim 1 further including a tensiometer mounted between each of the tensioning straps and the urging means so that a selected tension may be applied at each attachment strap.

* * * * *